US008240807B2

(12) United States Patent
Bastani et al.

(10) Patent No.: US 8,240,807 B2
(45) Date of Patent: Aug. 14, 2012

(54) CALIBRATION PROCESS FOR MULTI-DIE PRINT CARTRIDGE

(75) Inventors: Behnam Bastani, San Diego, CA (US); Alejandro Campillo Agusti, San Diego, CA (US); Bryan S. Ly, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 544 days.

(21) Appl. No.: 12/436,737

(22) Filed: May 6, 2009

(65) Prior Publication Data

US 2010/0283809 A1 Nov. 11, 2010

(51) Int. Cl.
*B41J 2/165* (2006.01)

(52) U.S. Cl. ..... 347/23

(58) Field of Classification Search ..... None
See application file for complete search history.

(56) References Cited

U.S. PATENT DOCUMENTS

| | | | | |
|---|---|---|---|---|
| 5,793,388 | A | 8/1998 | Martinson et al. | |
| 6,139,125 | A * | 10/2000 | Otsuka et al. | 347/11 |
| 6,273,542 | B1 | 8/2001 | Couwenhoven et al. | |
| 6,517,183 | B2 | 2/2003 | Bruch et al. | |
| 6,644,772 | B2 | 11/2003 | Choi | |
| 6,896,350 | B2 | 5/2005 | Gomez et al. | |
| 6,995,863 | B1 | 2/2006 | Miguel | |
| 7,023,581 | B2 | 4/2006 | Soler et al. | |
| 7,027,185 | B2 | 4/2006 | Subirada et al. | |
| 7,055,925 | B2 | 6/2006 | Subirada et al. | |
| 7,156,482 | B2 | 1/2007 | Boleda et al. | |
| 7,364,254 | B2 | 4/2008 | Yamazaki et al. | |
| 7,387,359 | B2 | 6/2008 | Hernandez et al. | |
| 2003/0081044 | A1 | 5/2003 | Gomez et al. | |
| 2003/0086102 | A1 | 5/2003 | Soler et al. | |
| 2003/0117455 | A1 | 6/2003 | Bruch et al. | |
| 2005/0024410 | A1 | 2/2005 | Subirada et al. | |
| 2005/0073545 | A1 | 4/2005 | Vilanova et al. | |
| 2006/0071963 | A1 | 4/2006 | Sampath et al. | |
| 2007/0097159 | A1 * | 5/2007 | Bastani | 347/5 |

* cited by examiner

*Primary Examiner* — Stephen Meier
*Assistant Examiner* — Tracey McMillion

(57) ABSTRACT

One exemplary embodiment is a method that performs a calibration process for determining a number of spit and wipe operations to place each of multiple dies on a print cartridge in a stable state.

24 Claims, 3 Drawing Sheets

CALIBRATION PROCESS FOR MULTI-DIE PRINT CARTRIDGE

BACKGROUND

Some print cartridges include multiple dies. Each die includes thousands of nozzles that deposit ink upon media.

Due to manufacturing variations, ink chemistry, and environmental effects of temperature and humidity on the printing process, the ink discharged from these dies can vary. For example, ink drop weight produced by different print heads often varies as a result of minute manufacturing differences in the size of the nozzles used in an inkjet print head, different resistor characteristics in the heater element used to eject the ink droplets in the inkjet print head, variations in the orifice shape, or any other difference from one print head to another. Differences in the ink chemistry combined with temperature and humidity also affect the final color appearance when applied to a print medium.

If corrections are not made for these differences, visible print quality defects are introduced on the media. Since the print swaths of the individual die are immediately adjacent each other, such defects are readily discernible, particularly when attempting to reproduce high quality graphics and images. For example, banding or non-uniformity can occur on printed photographs.

DETAILED DESCRIPTION

Exemplary embodiments are directed to apparatus, systems, and method that perform a calibration process to get each die of a multi-die print cartridge into a stable state before printing operations commence.

Exemplary embodiments use a calibration process to achieve color uniformity in a Page Wide Array (PWA) printing system that uses multi-die printheads. During the calibration process, dies with different density profiles are individually stabilized so subsequent print jobs print with uniform color density on print media. As such, excessive ink and servicing material usage is reduced or eliminated.

The dies on a print cartridge undergo one or more service cycles of printing, spitting, and wiping. These cycles repeat for each die until all dies on the cartridge or pen are at a stable state. The calibration process determines an optimal or efficient number or length of time to execute the servicing cycles for each die. For example, individual dies on the same cartridge can require a different number of servicing cycles to place the dies in a stable state before printing commences. Exemplary embodiments determine the number of these cycles for each respective die on a cartridge.

Exemplary embodiments determine optimal servicing and printing routines to reach steady state. By having the print head reach a constant firing profile, non-uniformities are corrected by a subsequent color calibration routine. Without such corrections in a multi-die print head using PWA, thermal variations within a die can cause banding (non-uniformity) when ink is deposited on the media. Instead of correcting these variations by applying more ink on the medium (which results in excess use of ink), exemplary embodiments determine an optimal number or amount of time required to place each die in its steady state. Once all dies on the cartridge are in their respective steady states, the density profile for the dies are constant, and non-uniformities can be accurately characterized and compensated. Time and resources are saved since excess spit and wipe operations are not performed on dies already in a stable state.

Figure 1:
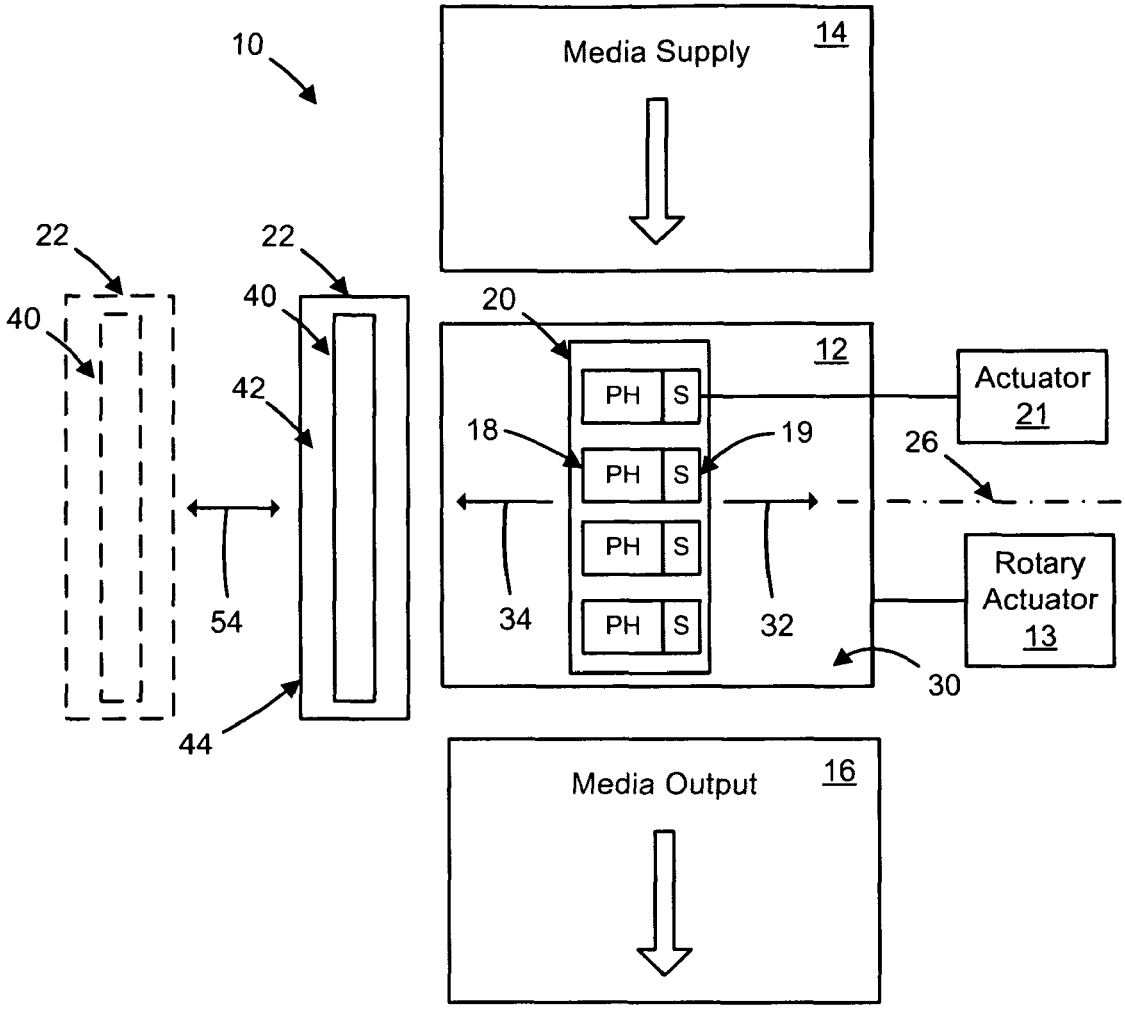
FIG. 1 is a schematic illustration of a printing system according to one exemplary embodiment.

FIG. 1 illustrates a printing system 10 according to one or more exemplary embodiments. Printing system 10 generally includes drum 12, rotary actuator 13, media supply 14, media output 16, printheads (PH) 18 with one or more sensors (S) 19, carriage 20, actuator 21, and web service station 22. Drum 12 generally comprises an elongated cylinder configured to be rotatably driven about axis 26 by rotary actuator 13 while transporting media, such as paper, about axis 26 relative to printheads 18. Rotary actuator 13 comprises a source of torque, such as a motor, operably coupled to drum 12 by a transmission (not shown).

Media supply 14, schematically shown, comprises a mechanism configured to supply media to drum 12. In one embodiment, media supply 14 comprises a mechanism configured to pick an individual sheet of media from a stack of media and to supply the individual sheet to drum 12 such that the sheet is wrapped at least partially about drum 12. Media output 16, schematically shown, comprises a mechanism to withdraw printed media from drum 12 and to transport withdrawn media to and contain withdrawn media within an output tray, bin or the like.

Printheads 18 dispense imaging material, such as ink, upon the medium held by drum 12. In one embodiment, printheads 18 are arranged in an arc about axis 26. Drum 12 has an outer surface 30 also arranged in an arc about axis 26. Although system 10 is illustrated as including four printheads, the number of printheads and configuration with respect to the carriage can vary. For example, system 10 can alternatively include a greater or fewer number of such printheads 18 supported by one or more carriages 20 regardless of whether the printheads and carriages are in an curved, linear, or other configuration.

Carriage 20 comprises one or more structures configured to support printheads 18 in the arcuate arrangement. In addition, carriage 20 is configured to movably support printheads 18 along axis 26. Actuator 21 comprises a linear actuator configured to move carriage 20 and printheads 18 in the directions indicated by arrows 32, 34 so as to selectively position printheads 18 opposite to the media held by drum 12 or opposite to service station 22. In one embodiment, actuator 21 comprises a motor.

Service station 22 comprises a station located on an axial end of drum 12 such that carriage 20 may position printheads 18 opposite, or adjacent, to station 22. Station 22 includes one or more components configured to perform servicing operations upon one or more of the printheads 18.

As shown by FIG. 1, service station 22 includes one or more webs 40 of material for performing servicing operations upon printheads 18. For instance, the service station can include two independent web feed spools (such as a wipe web spool and a spit web spool) or one single web spool with one single web used for both wiping and spitting the printheads. For ease of illustration, a single web 40 is shown, but exemplary embodiments include multiple webs for servicing printheads 18.

In one embodiment, web 40 is configured to interact with printheads 18 by receiving printing material or ink discharged from printheads 18. For example, in one embodiment, printheads 18 include multiple nozzles. Web 40 facilitates spitting of ink from the nozzles to clear such nozzles. In one embodiment, web 40 comprises a web of fluid absorbent material and/or a fabric material. In one embodiment, web 40 comprises an elongate band of material configured to perform a distinct servicing operation upon printheads 18, such as contacting and wiping the printheads.

The service station 22 further includes a housing 42 and a track 44. Housing 42 comprises one or more walls, panels, structures and the like configured to support track 44 and web 40 relative to drum 12. In one embodiment, service station 22 is configured to be inserted adjacent to or removed from drum 12 as indicated by arrows 54. The service station 22 shown in dashed lines indicates it being removed from or inserted into the printing system. The removability of service station 22 facilitates replacement, repair, refurbishment, or refilling of the unit and/or components thereof. For example, when web 40 becomes sufficiently saturated with printing material or ink from printheads 18, service station 22 is removed and either replaced with an entirely new cartridge or be refilled with another one of web 40.

In one embodiment, to service the printheads 18, clean web 40 is positioned underneath the printheads 18. After the printheads 18 are serviced, namely wiped and/or spat, the web 40 is advance and wrapped around a web roller.

Figure 2:
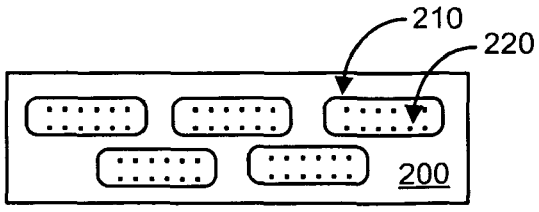
FIG. 2 is a top plan view of a print cartridge with multiple dies according to one exemplary embodiment.

FIG. 2 is a top plan view of a printhead or print cartridge 200 with multiple separate dies 210 according to one exemplary embodiment. Each die includes hundreds or thousands of nozzles 220.

In one exemplary embodiment, the print cartridge 200 is used in a PWA printing system (such as the system 10 shown in FIG. 1). A PWA printing system includes print cartridges or pens with multiple dies, with each die having thousands of nozzles. Ink is delivered from a resident reservoir to a nozzle chamber of each nozzle. When printing, a firing resistor within a nozzle chamber is activated so as to heat the ink therein and cause a vapor bubble to form. The vapor bubble then ejects the ink as a droplet. Droplets of repeatable velocity and volume are ejected from respective nozzles to effectively imprint characters and graphic markings onto a media sheet. The PWA printhead prints one or more lines at a time as the page moves relative to the printhead.

Figure 3:
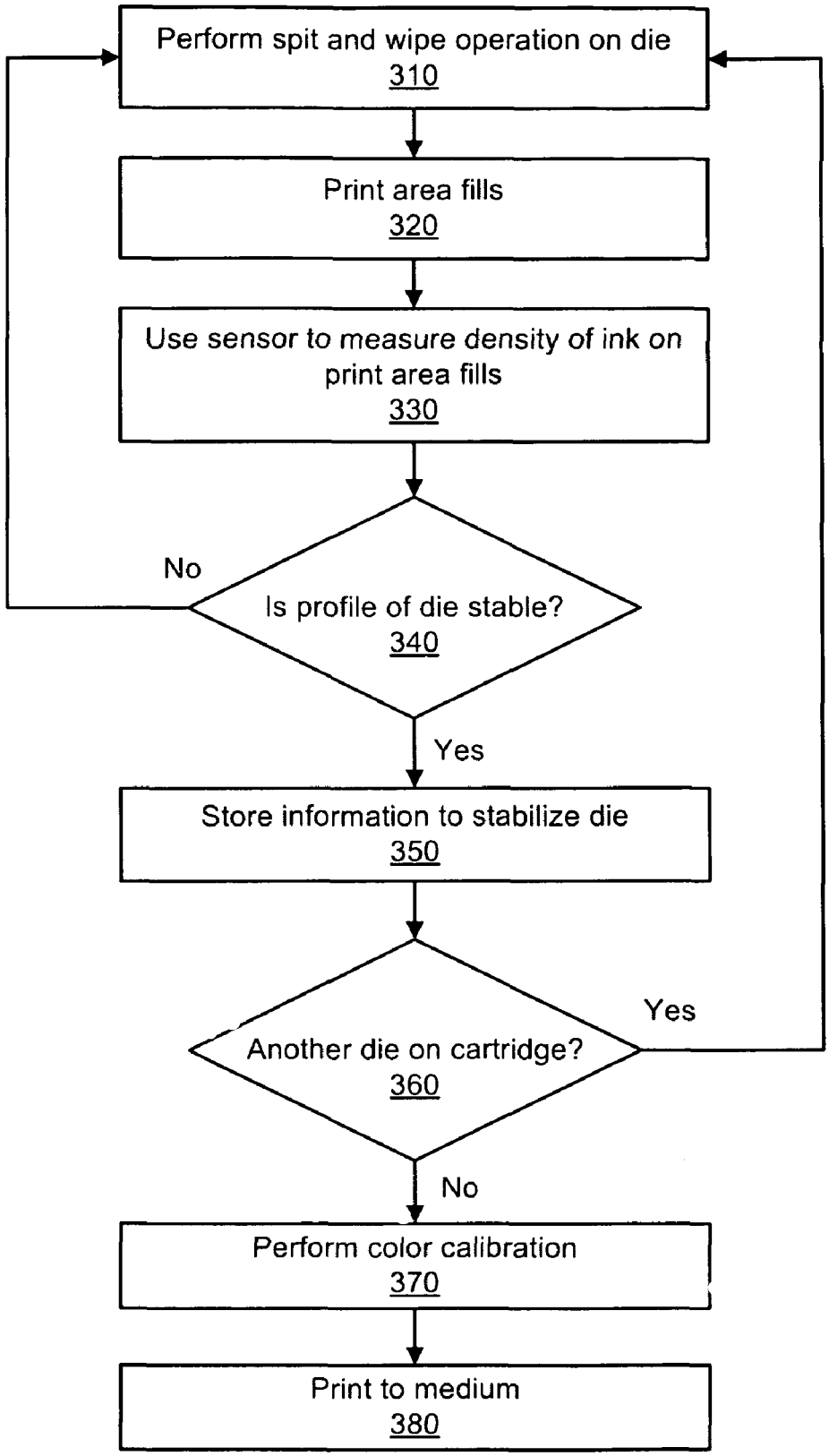
FIG. 3 is a flow diagram of a calibration method to determine spit and wipe operations performed to get each die on a print cartridge into a stable state without excess ink or service material usage according to one exemplary embodiment.

FIG. 3 is a flow diagram of a calibration method to determine spit and wipe operations performed to get each die on a print cartridge into a stable state without excess ink or service material usage according to one exemplary embodiment. The calibration method determines an optimal or minimal number of print, spit, and wipe cycles to perform for each die on a print cartridge to place the respective dies in a stable state.

According to block 310, one or more spit and/or wipe operations are performed on a die of a multi-die print cartridge (such as the cartridge 200 shown in FIG. 2). For example, a predefined number of spit/wipe operations or cycles are performed.

In one exemplary embodiment, the spit and wipe operations are performed to calibrate or determine a number of such operations required to place a die into a stable state. A spit operation is specifically an operation in which a predetermined amount of ink is ejected from an inkjet nozzle. The inkjet nozzle is fired a number of times at high frequency to eject this predetermined amount of ink. A wipe operation is an operation in which a wiper is moved in relation to the inkjet nozzle to clean any ink on or around the nozzle. Alternately, ink can be removed from the inkjet nozzle by using other devices or methods, such as using suction.

According to block 320, a print area fills are printed with the die. Here, the die prints a sample on a designated print area. For example, each die prints a test area at a unique location that has no overlap with print locations of other dies.

According to block 330, a sensor (such as sensor 19 shown in FIG. 1) measures the density of ink printed by the die on the print area fills. The area fills are created by one single ink colorant. In one exemplary embodiment, a light emitting diode (LED) based densitometer measures optical density of the area fill for each die. To improve robustness of the calibration method of sensor to paper spacing, profile of a blank media is measured. After this measurement, sensor measurements are normalized by reading of white on the same location to remove any sensor to paper spacing effect.

When the normalized LED readings of the primary color patches are collected, the method compares previous measurement on the same location to the latest measurement. According to block 340, variations between two consecutive measurements are used to decide whether the die is at a steady or stable state. If the answer to this determination is "no" then flow loops back to block 310. If the answer to this determination is "yes" then flow proceeds to block 350. A counter or other device is used to record the number of spit/wipe operations or cycles performed on each die to place the die in a stable state.

In one embodiment, a die is determined to be in a steady or stable state when variations to the density profile are within an acceptable range. In the steady state, each die behaves in a consistent manner that can be characterized and compensated. A print cartridge or pen is ready to be characterized and compensated when all dies on the cartridge are at a steady or stable state.

By looking at the profile of the variation until the print stabilizes, exemplary embodiments determine how many drops of inks were used in each portion of the die. Using this information, a determination is made as to how much printing, spitting and wiping (i.e., servicing) are required for each portion of the die. The calibration process customizes the servicing performed for each individual die.

According to block 350, if the die is in a steady or stable state, then information to obtain this steady state for the die is stored in memory. For example, the number of spit and wipe operations to place the die in the stable state is stored (for example, stored in a memory of the printer).

According to block 360, a determination is made as to whether another die is on the cartridge. If the answer to this determination is "yes" then flow proceeds to block 310. If the answer to this determination is "no" then flow proceeds to block 370 where color calibration is performed.

Before printing to a medium, a color calibration process is invoked. This process is invoked after the dies on the print cartridge are in the stable state according to the calibration process of FIG. 3. An example of this color calibration process is taught in United States publication number 2008/0100658 having application Ser. No. 11/588,244, filed Oct. 27, 2006, and incorporated herein by reference.

After the color calibration process, the print cartridge is ready to print to a medium at block 380.

The calibration method of FIG. 3 is performed for each print cartridge and for each die on each print cartridge. Thus for each die, a determination is made as to how much or how long to run or execute a spit/wipe process to transition the dies to a stable state.

This calibration process allows for a more efficient servicing to remove ink enrichment before running color calibration for multi-die printheads. The calibration process improves the success rate of the calibrations and also reduces ink/servicing material waste.

Individual dies on a same print cartridge can have different optimal spit/wipe cycles or durations. For example, one die may be required to undergo N spit/wipe cycles to place the die in a stable state, while other dies on the same cartridge are required to undergo N+X or N−Y spit/wipe cycles to place the respective dies in a stable state. As such, some dies on the print cartridge can be finished with the spit/wipe process (i.e., in a stable state) while other dies on the cartridge continue to undergo the spit/wipe process until they too achieve the stable state. Once all dies on the print cartridge are in a stable state, the print cartridge is ready to perform print operations.

Figure 4:
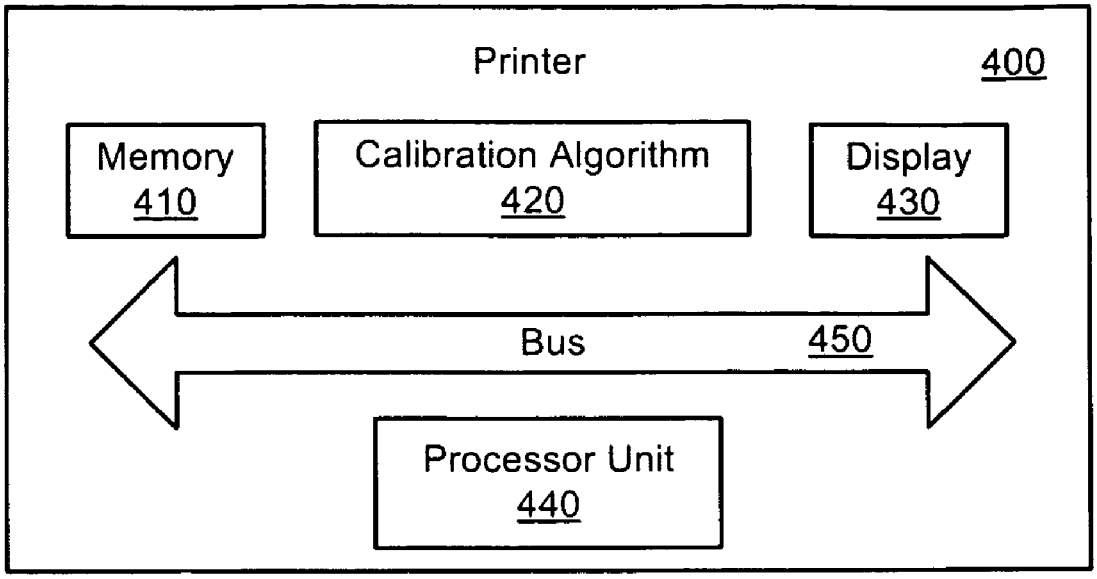
FIG. 4 is a block diagram showing a printer according to one exemplary embodiment.

FIG. 4 is a block diagram showing a printer 400 according to one exemplary embodiment. The printer includes a memory 410, calibration algorithm 420, display 430, processing unit 440 and one or more buses 450.

In one embodiment, the processor unit includes a processor (such as a central processing unit, CPU, microprocessor, application-specific integrated circuit (ASIC), etc.) for controlling the overall operation of memory 410 (such as random access memory (RAM) for temporary data storage, read only memory (ROM) for permanent data storage, and firmware). The memory 410, for example, stores applications, data, programs, algorithms (including diagrams and methods discussed herein), and other data associated with the printer. The processing unit 440 communicates with memory 410 and display 430 via one or more buses 450.

Definitions

As used herein and the claims, the following terms are defined as follows:

The term "Page Wide Array" or "PWA" is a printing system wherein each portion of a print medium is printed with a single segment of a die.

The term "stable state" or "steady state" occurs when a die on a cartridge has a consistent density profile from print to print. For example, a steady state occurs when the ink at the die has a stable, steady fluid temperature. Thus, a steady state occurs when the density profile of a die becomes consistent and constant from one print to the next print. As the die reaches a constant temperature, the density across the area or test fill is the same on print N, N+1, N+2. By achieving a constant density profile, exemplary embodiments can then compensate for any non-uniformity by applying more ink drops where necessary (such as described in block 370 of FIG. 3).

In one exemplary embodiment, one or more blocks or steps discussed herein are automated. In other words, apparatus, systems, and methods occur automatically. As used herein, the terms "automated" or "automatically" (and like variations thereof) mean controlled operation of an apparatus, system, and/or process using computers and/or mechanical/electrical devices without the necessity of human intervention, observation, effort and/or decision.

The methods in accordance with exemplary embodiments are provided as examples and should not be construed to limit other embodiments. For instance, blocks in diagrams or numbers (such as (1), (2), etc.) should not be construed as steps that must proceed in a particular order. Additional blocks/steps may be added, some blocks/steps removed, or the order of the blocks/steps altered and still be within the scope of the exemplary embodiments. Further, methods or steps discussed within different figures can be added to or exchanged with methods of steps in other figures. Further yet, specific numerical data values (such as specific quantities, numbers, categories, etc.) or other specific information should be interpreted as illustrative for discussing exemplary embodiments. Such specific information is not provided to limit embodiments.

Various embodiments are implemented as a method, system, and/or apparatus. As one example, exemplary embodiments and steps associated therewith are implemented as one or more computer software programs to implement the methods described herein. The software is implemented as one or more modules (also referred to as code subroutines, or "objects" in object-oriented programming). The location of the software will differ for the various alternative embodiments. The software programming code, for example, is accessed by a processor or processors of the computer or server from long-term tangible storage media of some type, such as a CD-ROM drive, ROM, hard drive, etc. The software programming code is embodied or stored on any of a variety of known media for use with a data processing system or in any memory device such as semiconductor, magnetic and optical devices, including a disk, hard drive, CD-ROM, ROM, firmware, etc. The code is distributed on such media, or is distributed to users from the memory or storage of one computer system over a network of some type to other computer systems for use by users of such other systems. Alternatively, the programming code is embodied in the memory and accessed by the processor using the bus. The techniques and methods for embodying software programming code in memory, on physical media, and/or distributing software code via networks are well known and will not be further discussed herein.

The above discussion is meant to be illustrative of the principles and various embodiments. Numerous variations and modifications will become apparent to those skilled in the art once the above disclosure is fully appreciated. It is intended that the following claims be interpreted to embrace all such variations and modifications.

What is claimed is:

1. A printer, comprising:

a print cartridge with multiple separate dies that each have plural ink jet nozzles;

a memory that stores a number of spit operations that eject ink and wipe operations; and a processor coupled to the memory and the print cartridge and having a calibration process to perform the number of the spit operations and the wipe operations to place each of the multiple separate dies in a stable state to uniformly print to a medium.

2. The printer of claim 1, wherein the stable state occurs when ink at each of the multiple separate dies has a stable, steady fluid temperature.

3. The printer of claim 1, wherein the number of spit and wipe operations is stored for each of the multiple separate dies.

4. The printer of claim 1, wherein the printer is a Page Wide Array (PWA) print system.

5. The printer of claim 1, further comprising a light emitting diode (LED) based densitometer that measures a density of ink printed by each of the multiple separate dies on a print test area.

6. The printer of claim 1, wherein two dies of the multiple separate dies have a different number of spit and wipe operations needed to place the two dies in the stable state.

7. The printer of claim 1 further comprising, a processor that executes an algorithm to determine the number of spit and wipe operations that are performed to place each of the multiple separate dies in the stable state to uniformly print to the medium.

8. A method, comprising:

performing using a processor, for each of multiple dies on a print cartridge, a calibration process that determines a number of spit operations that eject ink and wipe operations executed to place each of the multiple dies in a stable state; and printing to a medium using the print cartridge after the multiple dies are in the stable state.

9. The method of claim 8 further comprising, repeating, for each of the multiple dies, cycles of printing, spitting, and wiping until the stable state is reached for the multiple dies.

10. The method of claim 8 further comprising, storing a number of print-spit-wipe cycles needed to place each of the multiple dies in the stable state.

11. The method of claim 8 further comprising, determining a length of time for executing cycles of print-spit-wipe to place each of the multiple dies in the stable state.

12. The method of claim 8, wherein the stable state occurs when a density across a test fill area is consistent from a first print to a second subsequent print to the test fill area.

13. The method of claim 8 further comprising, determining a minimal number of print, spit, and wipe cycles needed to be executed to place each of the multiple dies in the stable state.

14. The method of claim 8 further comprising, measuring a density of ink printed onto a medium by one of the multiple dies to determine when the one of the multiple dies is in the stable state.

15. A tangible computer readable medium having instructions for causing a computer to execute a method, comprising:

executing using the computer, for each of plural dies on a print cartridge, a calibration process that performs a predetermined number of spit operations that eject ink and wipe operations on each of the plural dies to place each of the plural dies in a stable state; and printing to a medium using the print cartridge after the plural dies are in the stable state.

16. The computer readable medium of claim 15, wherein the predetermined number of spit and wipe operations differs for two dies on the cartridge.

17. The computer readable medium of claim 15, wherein the predetermined number is a minimum number of spit and wipe operations needed to place each of the plural dies in the stable state.

18. The computer readable medium of claim 15, wherein the stable state occurs when a density profile of the plural dies becomes consistent and constant from a first print to a second print.

19. The computer readable medium of claim 15, further comprising, executing the calibration process for one of the plural dies while another of the plural dies is already in the stable state.

20. The computer readable medium of claim 15, further comprising, reading the predetermined number of spit and wipe operations from a memory in a printer.

21. The method of claim 8, comprising:

after performing the calibration process, servicing the print cartridge by performing the number of the spit and wipe operations to place the multiple dies in the stable state before commencing the printing.

22. The method of claim 8, wherein the printing prints desired markings onto the medium without ink non-uniformities, the method further comprising:

after the multiple dies are in the stable state and before the printing, performing a color calibration operation to correct the ink non-uniformities.

23. The method of claim 22, wherein the color calibration operation compensates for thermal variations within the print cartridge that influence the ink non-uniformities.

24. The method of claim 22, wherein the color calibration operation corrects for the ink non-uniformities by applying additional ink drops to the medium from portions of the print cartridge corresponding to the non-uniformities.

* * * * *